United States Patent [19]

Ausnit

[11] Patent Number: 4,625,496

[45] Date of Patent: Dec. 2, 1986

[54] METHOD AND APPARATUS FOR FORMING A RECLOSABLE PACKAGE

[75] Inventor: Steven Ausnit, New York, N.Y.

[73] Assignee: Minigrip, Inc., Orangeburg, N.Y.

[21] Appl. No.: 743,423

[22] Filed: Jun. 11, 1985

[51] Int. Cl.[4] ..... B65B 9/00

[52] U.S. Cl. ..... 53/451; 53/551; 156/203; 156/466

[58] Field of Search ..... 53/450, 451, 551, 552; 156/66, 203, 466, 73.4; 493/302

[56] References Cited

U.S. PATENT DOCUMENTS

| | | | |
|---|---|---|---|
| 3,815,317 | 6/1974 | Toss | 53/551 |
| 3,948,705 | 4/1976 | Ausnit | 156/73.4 |
| 4,355,494 | 10/1982 | Tilman | 53/451 |

*Primary Examiner*—John Sipos
*Assistant Examiner*—Donald R. Studebaker
*Attorney, Agent, or Firm*—Kane, Dalsimer, Kane, Sullivan and Kurucz

[57] ABSTRACT

A method and apparatus for forming plastic bags with zipper profile thereon, in situ, on a form and fill machine. Plastic film sheeting containing profiles is moved over a forming collar disposed about the filling spout of the machine. A major portion of the film is formed into a tube about the spout while a minor portion of the film, including the profiles, is directed away from the spout. After the tube is formed and filled, the major and minor portions are brought into alignment and transverse seams are formed on opposite sides of the product to form the bag.

14 Claims, 12 Drawing Figures

METHOD AND APPARATUS FOR FORMING A RECLOSABLE PACKAGE

BACKGROUND OF THE INVENTION

The present invention relates to packaging and in particular to an improved method for forming a reclosable package, in situ, on vertical form and fill equipment.

In U.S. Pat. Nos. 3,827,472 and No. Re 28,969 there is disclosed a reclosable package formed from a plastic film material. The film is provided with male and female zipper profiles which form mating closures for the final package. As discussed in U.S. Pat. Re 28,959, in order to insure that the profiles of the final package will properly align with each other, the profiles of the film must be joined together before cross seams are made transverse to the profiles to form the sides of the package.

In vertical form and fill machines a plastic sheet is drawn across a forming collar past and around a filling spout. The film is first seamed longitudinally to form a tube which is then seamed transversely before a product is dropped into the tube from the spout and then seamed again transversely after the product is introduced to thereby form a package about the product. The second transverse seam then serves as the first seam for the next package and the process is repeated.

While it is often desirable to package products normally filled on form fill equipment in reclosable packaging, it has not been possible to do so heretofore with conventional form fill equipment because of the difficulties in handling the profiles. While the profile could be joined before the film is formed into a tube it should be realized that if the profiles are so joined they must somehow be brought over the forming collar in such a manner as to insure that the profiles do not inadvertently open during the package forming process.

In view of the above, it is the principal object of the present invention to provide an improved method of forming reclosable plastic bags, in situ, on vertical form and fill equipment;

A further object is to provide such a method wherein the bags may be formed with a minimum amount of modification of the form filling equipment;

A still further object is to provide a simplified apparatus for effecting the above method.

SUMMARY OF THE INVENTION

The above and other beneficial objects and advantages are attained in accordance with the present invention by moving a sheet of profile film longitudinally over a forming collar and about a filling spout. A minor portion of the film cross-section, including the profiles is moved away from the pouring spout to a position generally transverse to the tangent to the main portion of the film. A longitudinal seam is formed to thereby produce a tube about the filling spout. A first transverse seam is formed across the tube, including the minor portion and, after product is introduced into the thus formed partially sealed tube and it has moved away from the filling spout a second transverse seam is formed spaced longitudinally from the first transverse seam whereby to complete the package about the product. The profiles may be joined prior to feeding the film over the forming collar or the profiles may be joined while the minor portion of the film is away from the filling spout.

DETAILED DESCRIPTION OF THE PREFERRED EMBODIMENTS

Figure 1:
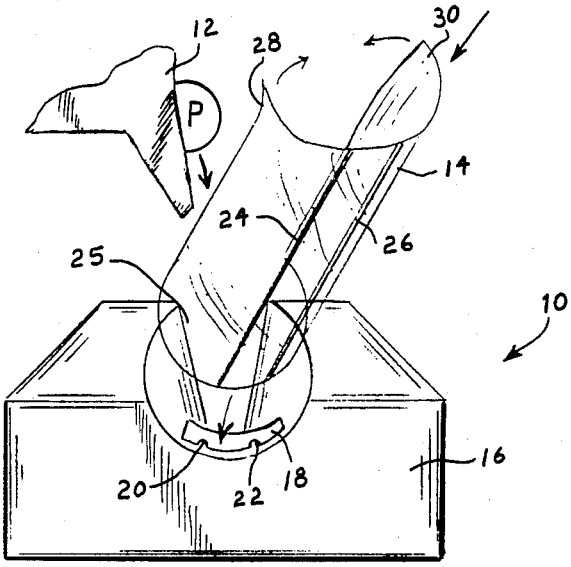
FIG. 1 is a simplified, perspective view of the filling spout and forming collar of a form-fill machine for practicing the method of the present invention.

Reference is now made to the drawings wherein two embodiments of the present invention are depicted. Referring to FIG. 1, the filling section of a form and fill machine 10 is shown comprising a filling spout 12 positioned to direct product into a bag to be formed. To that end, plastic film sheeting 14 is fed over a forming collar 16. The film is directed to form a tube seaming the longitudinal edges of the film to each other. A first transverse or cross seam is then formed to thereby produce a pocket. Product "P" is then introduced into the pocket after which a second cross seam is formed to complete the package about the product P.

Figure 3:
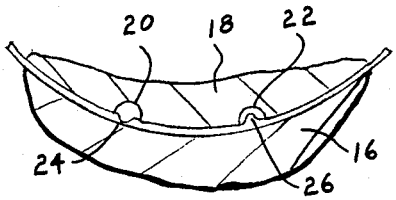
FIGS. 3–6 are fragmentary plan views taken along reference lines 3—3, 4—4, 5—5, and 6—6 respectively of FIG. 2.
Figure 4:
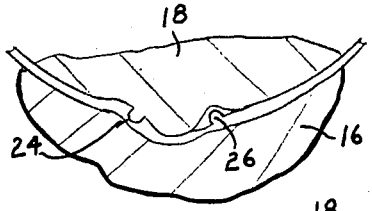
Figure 5:
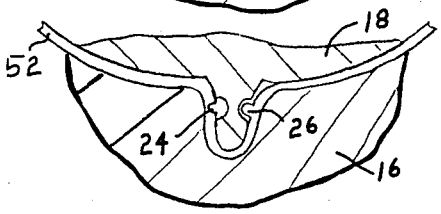
Figure 6:
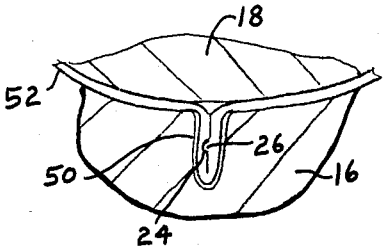
Figure 7:
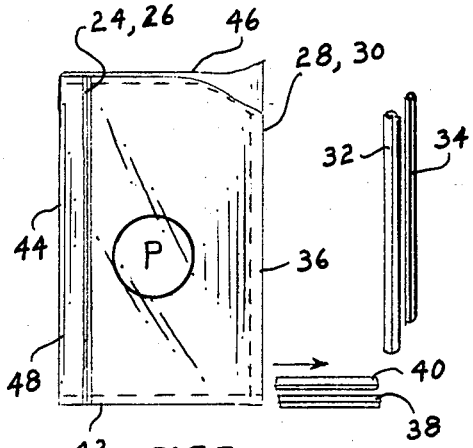
FIG. 7 is a simplified perspective view depicting the longitudinal and cross seam forming in accordance with the present invention.
Figure 8:
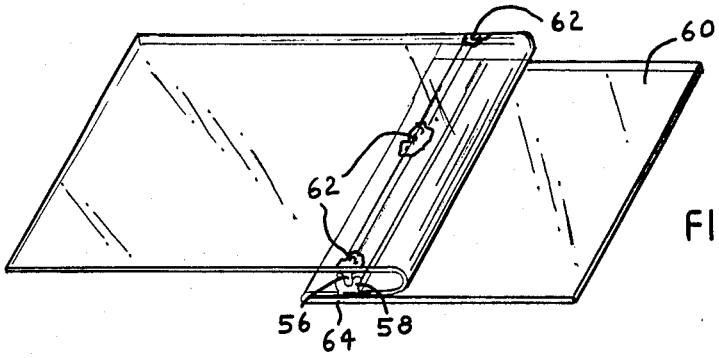
FIG. 8 is a perspective view of prejoined profile film used in accordance with an alternative embodiment of the method of the present invention.
Figure 9:
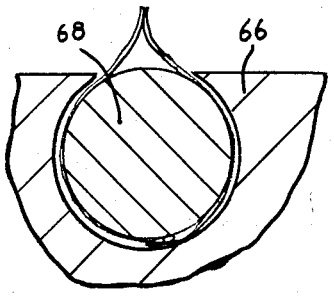
FIG. 9 is a fragmentary plan view of the forming collar and guide used in accordance with the alternative embodiment; and, FIGS. 10, 11, and 12 are fragmentary sectional plan views taken along the forming collar moving in the direction of movement of the product.

In accordance with the present invention, in order to permit the cross seams described above to be formed on profile film (i.e. film containing zipper profiles to form the closures for a reclosable bag), a reverse cam 18 is provided on the interior of the forming collar 16. The profiles may either be formed integral with the film or may be attached to the film. As shown in FIGS. 2–6 the reverse cam 16 includes a pair of spaced recesses which serve to capture the male and female profiles 24, 26 and guide them away from filling spout 12 and into alignment with each other (as shown in FIGS. 3–5) and then into engagement (as shown in FIG. 6). As the closures are being brought into engagement the forming collar 16 forms the film into a tube about the filling spout 12 by bringing the longitudinal edges 28, 30 of film 14 together after which the edges are joined with heated seaming knives 32, 34. As the longitudinal seam is formed the tube is guided into a slot 25 which serves to flatten the tube. After the longitudinal seam 36 is formed a first transverse seam 42 is formed across the flattened tube by heated seaming knives 38, 40. Product P is then introduced into the pocket defined by the folded longitudinal edge 44 of the tubing (formed when profiles 24, 26 are joined to each other), transverse seam 42, and longitudinal seam 36. The film then continues to move vertically downwardly until it is in position for the next transverse seam 46 which completes the bag formed about product P and also forms the first transverse seam for the next bag to be produced and the process then repeats. The folded edge 44 may be slit open so that only the closures 20, 24 keep the bag closed or the edge 44 may be kept intact in which case the resultant bag is "pilfer proof" in that edge 44 must be slit before product P may be removed and this would be readily apparent.

It is important to note that as the film passes through the forming collar the minor cross sectional portion 50 (defined substantially as the shorter distance between the profiles) and the major portion 52 (defined substantially as the major distance between the profiles) are brought into alignment with each other to enable the transverse seaming knives 38, 40 to seam both portions in a single operation. This results from slot 25 being opposite reverse cam 16.

Figure 10:
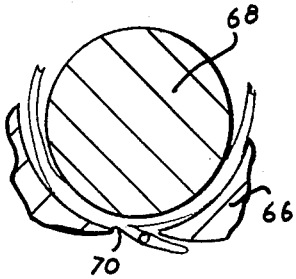
Figure 11:
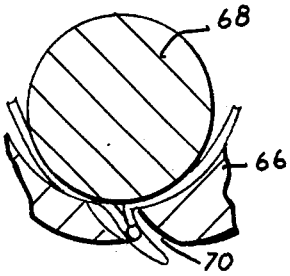
Figure 12:
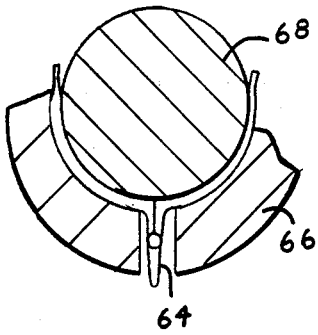
Figure 2:
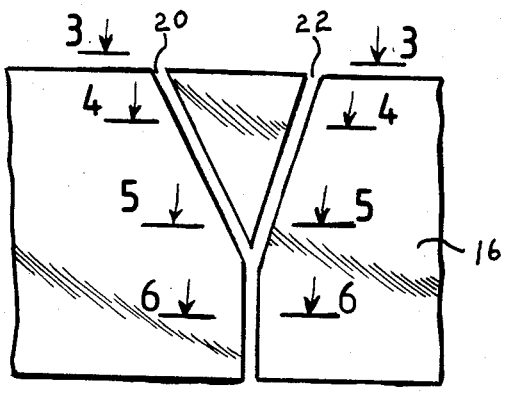
FIG. 2 is a projected view of the camming surface of the forming collar of FIG. 1.

In FIGS. 8–12 a second embodiment of the present invention is depicted. In this embodiment the profiles 56, 58 of film 60 are prejoined before the film is brought to the filling machine 10. In addition, spot seals 62, may be provided along the joined film through the profiles. The spot seams, in addition to securing the edges of the profiles to each other also serve to flatten the profiles so that more secure cross seams may be formed. In accordance with this embodiment the minor portion 64 of the film (i.e. containing the joined closed profiles) is folded over the major portion as shown. As the film is fed over forming collar 66 and the major portion of the film is formed into a tube about filling spout 68, the minor portion of the film is fed to a camming portion 70 of the forming collar which serves to unfold the folded portion (as shown in FIGS. 10–12). When the minor portion is unfolded (as shown in FIG. 12) the first cross seam may be made through the spot seals 62. In other ways the forming and filling of the bag of this embodiment are the same as that of the first embodiment.

Thus in accordance with the above, the aforementioned objectives are effectively attained.

Having thus described the invention, what is claimed is:

1. A method for forming reclosable plastic bags from plastic sheeting having longitudinally extending zipper profiles thereon, in situ, on a form and fill machine of the type having a collar disposed about a filling spout, said plastic sheet having a major portion and said profiles defining a minor portion formed substantially centrally on said major portion, said method comprising:

moving said sheeting longitudinally across said collar;

guiding said major portion about said pouring spout and joining the longitudinal edges of said sheeting to form a tube;

guiding said minor portion and said profiles away from said pouring spout;

flattening said major portion and said minor portion to form a transverse sealing zone;

forming a first transverse seam across said major and minor portions at said traverse zone whereby to form a pocket;

introducing product into said pocket and, thereafter, forming a second transverse seam spaced across the product from the first transverse seam to thereby form a bag about said product.

2. The method in accordance with claim 1 wherein said profiles are interlocked while said minor portion is away from the pouring spout.

3. The method in accordance with claim 2 wherein said profiles are guided into alignment with each other as said minor portion is guided away from said pouring spout.

4. The method in accordance with claim 1 wherein said profiles are interlocked prior to moving said sheeting across said collar.

5. The method in accordance with claim 4 wherein said minor portion is folded over said major portion prior to moving said sheeting over said collar.

6. The method in accordance with claim 5 wherein said minor portion is guided to unfold and extend radially outwardly from said major portion prior to forming the first transverse seam.

7. The method in accordance with claim 6 comprising the further step of collapsing the tube to align with the minor portion prior to forming the first seam.

8. The method in accordance with claim 4 comprising the further step of forming spot welds through the joined profiles prior to moving the sheeting across said collar and forming the transverse seams through said spot seals.

9. In a form and fill machine of the type having a pouring spout and a collar disposed about the spout for guiding plastic sheeting around the spout to form a tube, the improvement comprising guide means for guiding a plastic sheeting having a major portion and longitudinally extending zipper profiles thereon which define a minor portion framed substantially centrally in said major portion, said guide means comprising means for receiving the minor portion, and for directing the minor portion away from the pouring spout while the major portio of the sheeting is formed into a tube about the spout.

10. The invention in accordance with claim 9 wherein said guide means includes surfaces for interlocking the profiles.

11. The invention in accordance with claim 10 wherein said guide means includes surfaces for bringing said profiles into alignment as said minor portion is guided away from the pouring spout.

12. The invention in accordance with claim 11 wherein said guide means directs said minor portion away from said spout generally radially.

13. The invention in accordance with claim 11 wherein said guide means includes a guide member attached to said pouring spout or collar, said member including a pair of profile channels which converge in the direction of movement of the sheeting.

14. The invention in accordance with claim 9 wherein said minor portion is initially folded over said major portion and said guide means is further provided for unfolding said minor portion as it directs said minor portion away from said spout.

* * * * *